US008169133B2

(12) United States Patent
Date et al.

(10) Patent No.: US 8,169,133 B2
(45) Date of Patent: May 1, 2012

(54) IMAGE DISPLAY APPARATUS, MANUFACTURING METHOD OF IMAGE DISPLAY APPARATUS, AND FUNCTIONAL FILM

(75) Inventors: Takashi Date, Machida (JP); Kaoru Koiwa, Tokyo (JP); Takahiro Oguchi, Sagamihara (JP); Keiji Suzuki, Yokohama (JP)

(73) Assignees: Canon Kabushiki Kaisha, Tokyo (JP); Kabushiki Kaisha Toshiba, Tokyo (JP)

( * ) Notice: Subject to any disclaimer, the term of this patent is extended or adjusted under 35 U.S.C. 154(b) by 654 days.

(21) Appl. No.: 11/961,765

(22) Filed: Dec. 20, 2007

(65) Prior Publication Data

US 2008/0157666 A1 Jul. 3, 2008

(30) Foreign Application Priority Data

Dec. 27, 2006 (JP) ..... 2006-352369
Oct. 10, 2007 (JP) ..... 2007-264751

(51) Int. Cl.
*H01J 1/62* (2006.01)
*H01J 63/04* (2006.01)

(52) U.S. Cl. ..... 313/495

(58) Field of Classification Search ..... 313/495–497
See application file for complete search history.

(56) References Cited

U.S. PATENT DOCUMENTS 6,445,367 B1 9/2002 Suzuki et al. ..... 345/75.2
6,534,924 B1 3/2003 Oguchi et al. ..... 315/169.1
6,661,179 B2 12/2003 Aoki et al. ..... 315/169.1
6,677,706 B1 1/2004 Hara et al. ..... 313/496
6,712,660 B2 3/2004 Aoki et al. ..... 445/3
6,760,001 B2 7/2004 Kanda et al. ..... 345/74.1
6,800,995 B2 10/2004 Ohnishi ..... 313/495
6,851,995 B2 2/2005 Takegami et al. ..... 445/6
6,888,519 B2 5/2005 Yamano et al. ..... 345/75.2
6,890,229 B2 5/2005 Aoki et al. ..... 445/3
6,958,578 B1 10/2005 Aoki et al. ..... 315/169.1
7,310,844 B1 12/2007 Rehkemper ..... 15/22.1
7,312,770 B2 12/2007 Onishi ..... 345/75.2
2003/0102798 A1* 6/2003 Ohnishi ..... 313/495
2005/0148272 A1 7/2005 Yamano et al. ..... 445/63

(Continued)

FOREIGN PATENT DOCUMENTS

EP 0 866 491 A2 9/1998

(Continued)

OTHER PUBLICATIONS

European Communication and Search Report dated Oct. 21, 2008, regarding Application No. 07150362.7-2208/1939922.

*Primary Examiner* — Toan Ton
*Assistant Examiner* — Zachary Snyder
(74) *Attorney, Agent, or Firm* — Fitzpatrick, Cella, Harper & Scinto

(57) ABSTRACT

There is provided an image display apparatus including: a first substrate having an electron-emitting device; a second substrate having an anode electrode that is opposed to the electron-emitting device; and a conductive layer that is provided on the side of a second face of the second substrate, the second face being an opposite face to a first face of the second substrate, the first face being located on the first substrate side, wherein a potential of the conductive layer is set to be lower than a potential of the anode electrode when displaying an image; and a surface resistance of the conductive layer is higher than a surface resistance of the anode electrode.

16 Claims, 11 Drawing Sheets

U.S. PATENT DOCUMENTS

| | | | | |
|---|---|---|---|---|
| 2005/0179398 | A1 | 8/2005 | Onishi | 315/169.2 |
| 2007/0080624 | A1 | 4/2007 | Koiwa et al. | 313/495 |

FOREIGN PATENT DOCUMENTS

| | | |
|---|---|---|
| JP | 10-326583 | 12/1998 |
| JP | 2001-281442 | 10/2001 |
| JP | 2003-229079 | 8/2003 |
| JP | 2005-235470 | 9/2005 |
| JP | 2006-189783 | 7/2006 |
| JP | 2006-189784 | 7/2006 |
| WO | WO 2006/011550 A1 | 2/2006 |
| WO | WO 2006/062251 | 6/2006 |

* cited by examiner

IMAGE DISPLAY APPARATUS, MANUFACTURING METHOD OF IMAGE DISPLAY APPARATUS, AND FUNCTIONAL FILM

BACKGROUND OF THE INVENTION

1. Field of the Invention

The present invention relates to an image display apparatus, a manufacturing method of the image display apparatus, and a functional film.

2. Description of the Related Art

Conventionally, as an electron-emitting device, a cold cathode electron-emitting device has been known. As a cold cathode electron-emitting device, a surface conduction electron-emitting device, a field emission type electron-emitting device (hereinafter, referred to as an FE type electron-emitting device), a metal-insulator-metal type electron-emitting device (hereinafter, referred to as an MIM type electron-emitting device) or the like have been known.

In Japanese Patent Application Laid-Open (JP-A) No. H10 (1998)-326583 (U.S. Pat. No. 6,677,706, EP No. 0866491), and JP-A No. 2003-229079 (U.S. Pat. No. 6,800,995), the applications to the image display apparatus of the surface conduction electron-emitting device and the image display apparatus of the FE type electron-emitting device are disclosed.

In JP-A No. 2001-281442, an optical filter provided on the surface of the image display apparatus is disclosed. In addition, in JP-A No. 2006-189783 and JP-A No. 2006-189784 (International Publication No. 2006/062251), an antireflection film with a conductive layer for a field emission display is disclosed.

FIG. 9 is an oblique perspective figure showing an example of a display panel of a flat type image display apparatus using an electron-emitting device. FIG. 9 also shows its inner structure.

In FIG. 9, a reference numeral 10005 denotes a rear plate (a first substrate), a reference numeral 10006 denotes a side wall, and a reference numeral 10007 denotes a face plate (a second substrate). Further, the rear plate 10005, the side wall 10006, and the face plate 10007 form an airtight container for maintaining the inner space of a display panel vacuum.

On the rear plate (the first substrate) 10005, N×M pieces of electron-emitting devices 10002 are formed. In addition, each of the electron-emitting devices 10002 is connected to a row wiring 10003 and a column wiring 10004, respectively, as shown in FIG. 9. A part configured by these electron-emitting devices 10002, row wiring 10003, and column wiring 10004 is referred to as an electron source.

On the lower face (the face on the side of the first substrate; a first face) of the face plate (the second substrate) 10007, a light emitting film 10008 is provided. In addition, on the face at the side of the rear plate 10005 of the light emitting film 10008, a metal back (an anode electrode) 10009 made of Al (aluminum) or the like is provided.

External terminals Dx1 to DxM, external terminals Dy1 to DyN, and an external terminal Hv are ones for electrically connecting this display panel to a drive circuit. Then, each of the external terminals Dx1 to DxM is electrically connected to each of the row wirings 10003 of an electronic source. Each of the external terminals Dy1 to DyN is electrically connected to each of the column wirings 10004 of an electronic source. The external terminal Hv is electrically connected to the metal back 10009.

In addition, the inner space of the airtight container is held vacuum about −6th power of 10 [Torr] (about 1.33*−4th power of 10 [Pa]). The display panel shown in FIG. 9 is provided with a supporting member (referred to as a spacer or a rib) 10010 for supporting air pressure to be added to the airtight container from the inside of the airtight container. A distance between the first substrate 10005 having the electron source provided thereon and the face plate 10007 having the light emitting film 10008 thereon is practically maintained in the range of 500 μm to 10 mm.

Upon driving of the image display apparatus using the above-described display panel, a voltage is applied to each of the electron-emitting devices 10002 through the external terminals Dx1 to DxM and the external terminals Dy1 to DyN. Then, an electron is emitted from each of the electron-emitting devices 10002. At the same time, by applying a high voltage from 1 [kV] to 40 [kV] to the metal back 10009 through the external terminal Hv, the emitted electron is allowed to crash against the light emitting film 10008. Thereby, the light emitting film 10008 emits a light and an image is displayed. Therefore, a partial area (the area where light emission from the light emitting film 10008 can be visually checked) of the upper face of the second substrate 10007 (the face located on the opposite side of the first face located on the side of the first substrate; a second face) is made into an image display area.

Therefore, the surface of the face plate 10007 (the surface on the opposite side of the side where the light emitting film 10008 is located; the second face) has a high voltage being affected by a potential of the metal back 10009 (namely, to be charged). Accordingly, during driving of the image display apparatus (during display of the image) or just after driving of the image display apparatus (just after display of the image), dust in air is attached to the face plate 10007 due to a static electricity.

Therefore, in order to reduce the potential of the image display area of the face plate (the second substrate) 10007, a conductive layer is provided on the image display area of the face plate 10007. Then, grounding this conductive layer on earth, for example, it is possible to prevent charge of the second face of the second substrate.

On the other hand, since a high voltage is applied to the metal back 10009, the electron-emitting device 10002, the row wiring 10003, and the column wiring 10004, which are located on the rear plate 10005 opposed to the metal back, are exposed to a high electric field. As a result, if there is a triple junction or a foreign substance, on which the electric field is concentrated, on the rear plate, the electric field is concentrated there and electric discharge may be generated inside the airtight container.

If electric discharge is generated, the electric charges accumulated on the face plate (typically, the metal back 10009) flow into the electron-emitting device 10002, the row wiring 10003, and the column wiring 10004 or the like. As a result, the electron-emitting device 10002 is destroyed and the drive circuit to be connected to the row wiring 10003 and the column wiring 10004 is destroyed, and this may cause a serious deterioration of an image quality.

Therefore, a method to give a current limiting function to the anode electrode (metal back) 10009 by means of the method described in JP-A No. H10 (1998)-326583 or the like has been suggested.

However, if charging inhibition processing is provided on the surface of the face plate by grounding the conductive layer as described above while giving the current limiting function to the anode electrode, a serious deficit of a pixel may be caused.

It seems that this may be caused because the apparent electric charge amount of the metal back 10009 is increased since a surface resistance (a sheet resistance) of the conductive layer is set to be lower than the apparent surface resistance of the metal back, so that the current limiting function of the second substrate is decreased when the electric discharge is generated inside the image display apparatus.

Accordingly, it is necessary to provide the conductive layer so as to prevent decrease of the current limiting effect of the metal back (the anode electrode) 10009 and prevent the electric charge of the surface of the image display apparatus.

SUMMARY OF THE INVENTION

An object of the present invention is to provide an image display apparatus that is provided with an conductive layer for satisfying electric functions such as (1) to prevent the electric charge of the image display area (2) while preventing increase of the electric charge amount of the metal back in a functional film to be mounted on an image display area of a face plate.

In order to attain the above object, the image display apparatus according to the present invention includes the followings.

The present invention provides a image display apparatus including: a first substrate having an electron-emitting device; a second substrate having an anode electrode that is opposed to the electron-emitting device; and a conductive layer that is provided on the side of a second face of the second substrate, the second face being an opposite face to a first face of the second substrate, the first face being located on the first substrate side, wherein a potential of the conductive layer is set to be lower than a potential of the anode electrode when displaying an image; and a surface resistance of the conductive layer is higher than a surface resistance of the anode electrode.

Further, according to the present invention, a potential defining electrode is provided on the first face of the second substrate apart from the anode electrode and around the anode electrode; and a potential of the potential defining electrode is set to be lower than the potential of the anode electrode when displaying an image.

In addition, according to the present invention, the potential defining electrode is provided so as to encircle the anode electrode on the second substrate.

According to the present invention, the potential of conductive layer and/or the potential defining electrode is a ground potential.

According to the present invention, the potential defining electrode and the anode electrode are connected to each other via a resistive film.

Further, according to the present invention, the image display apparatus further includes a third substrate that is provided on the side of the second face of the second substrate; wherein the third substrate is provided on the side of the second face spatially apart from the conductive layer and has an antireflection property.

Further, according to the present invention, the image display apparatus further includes a conductive antireflection layer that is provided to be located on the opposite side of the conductive layer from the second substrate and is set to be lower than the potential of the anode electrode when displaying an image; wherein a surface resistance of the antireflection layer is higher than the surface resistance of the anode electrode.

According to the present invention, the surface resistance of the antireflection layer is higher than the surface resistance of the conductive layer.

According to the present invention, the conductive layer is fixed on an insulating base; and the conductive layer is attached on the second face of the second substrate via an adhesive layer.

According to the present invention, the conductive layer is fixed on one face of an insulating base and the antireflection layer is fixed on the other face of the insulating base; and the conductive layer is attached on the second face of the second substrate via an adhesive layer.

In addition, the present invention provides a functional film according to the present invention mounted on an image display apparatus including a first substrate having an electron-emitting device and a second substrate having an anode electrode that is opposed to the electron-emitting device, the functional film comprising a conductive layer that is provided on the side of a second face of the second substrate, the second face being an opposite face to a first face of the second substrate, the first face being located on the first substrate side, wherein a potential of the conductive layer is set to be lower than a potential of the anode electrode when displaying an image; and a surface resistance of the conductive layer is higher than a surface resistance of the anode electrode.

In addition, a manufacturing method of an image display apparatus according to the present invention includes the steps of preparing a display panel including a first substrate having an electron-emitting device and a second substrate having an anode electrode that is opposed to the electron-emitting device; and providing a conductive layer on the side of a second face of the second substrate, the second face being an opposite face to a first face of the second substrate, the first face being located on the first substrate side, wherein a potential of the conductive layer is set to be lower than a potential of the anode electrode when displaying an image; and a surface resistance of the conductive layer is higher than a surface resistance of the anode electrode.

According to the present invention, even if electric discharge is generated inside the image display apparatus, it is possible to keep a current limiting effect of the anode electrode and to prevent increase of a potential of the image display area of the image display apparatus.

Further features of the present invention will become apparent from the following description of exemplary embodiments with reference to the attached drawings.

DESCRIPTION OF THE EMBODIMENTS

Figure 1:
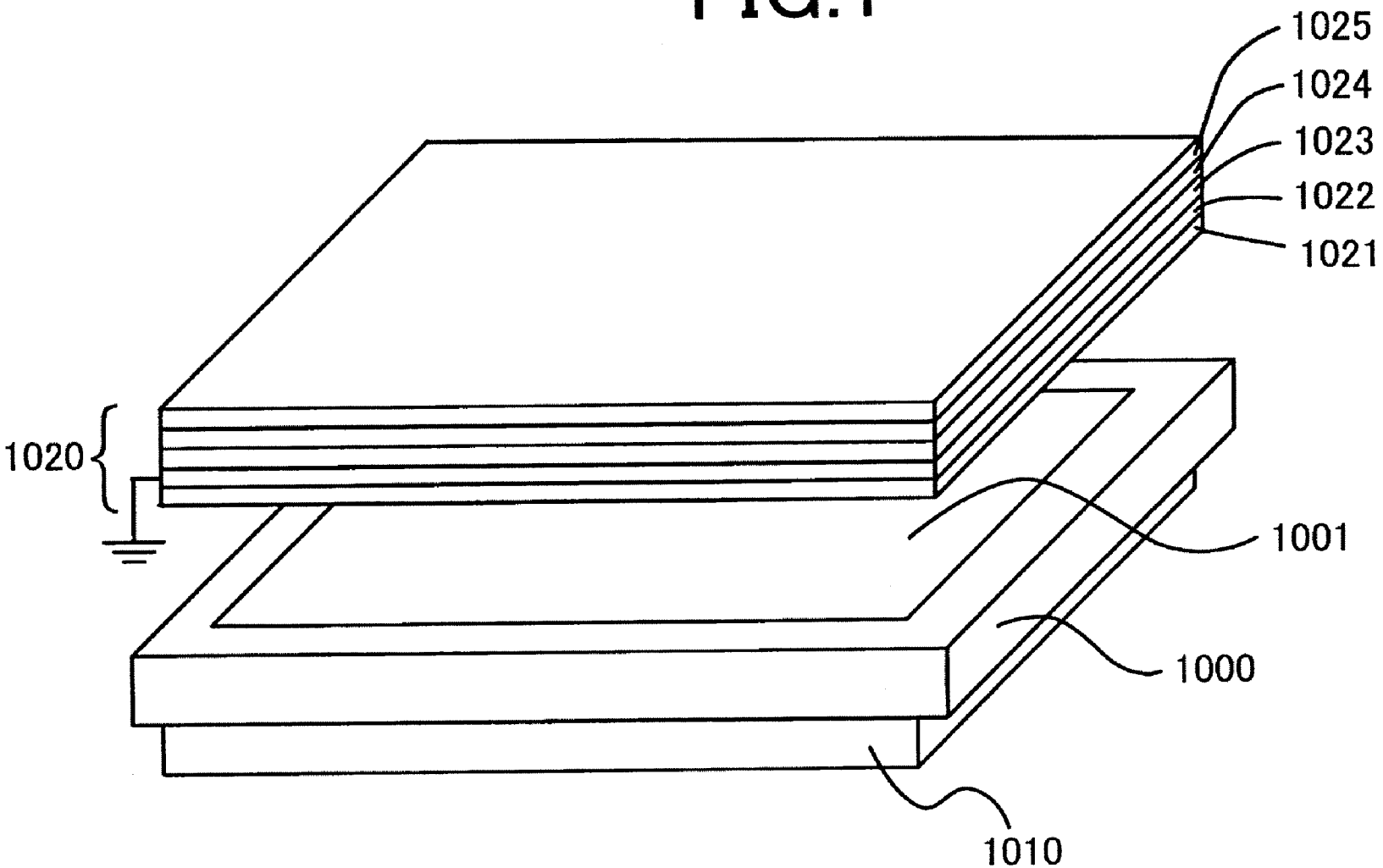
FIG. 1 is a typical view of an image display apparatus according to a first embodiment of the present invention.

Hereinafter, with reference to the drawings, the preferable embodiments of the present invention will be described in detail. Further, with respect to the all drawings of the following embodiments, the same reference numerals are given to the same or the corresponding parts.

First Embodiment

At first, an image display apparatus according to the first embodiment of the present invention will be described below. In FIG. 1, a typical view of an image display apparatus according to the first embodiment of the present invention is shown.

The image display apparatus according to the present embodiment is configured by an image display apparatus main body (a display panel) 1000, a drive circuit 1010, and a functional film 1020. In FIG. 1, the image display apparatus main body 1000 is separated from the functional film 1020; however, in the real constitution, the functional film 1020 is allowed to contact the image display area 1001 of the image display apparatus main body 1000. In addition, although the drive circuit 1010 is provided on the rear face of the image display apparatus main body 1000 in FIG. 1, the arrangement position of the drive circuit is not limited to such an arrangement position.

According to the present embodiment, an example of using the surface-conduction electron-emitting device as an electron-emitting device for the image display apparatus main body (the display panel) represented by 1000 will be described; however, other electron-emitting device may be also used. A reference numeral 1001 represents an image display area of the image display apparatus main body 1000 (the image display area of a second substrate 1003).

Figure 2:
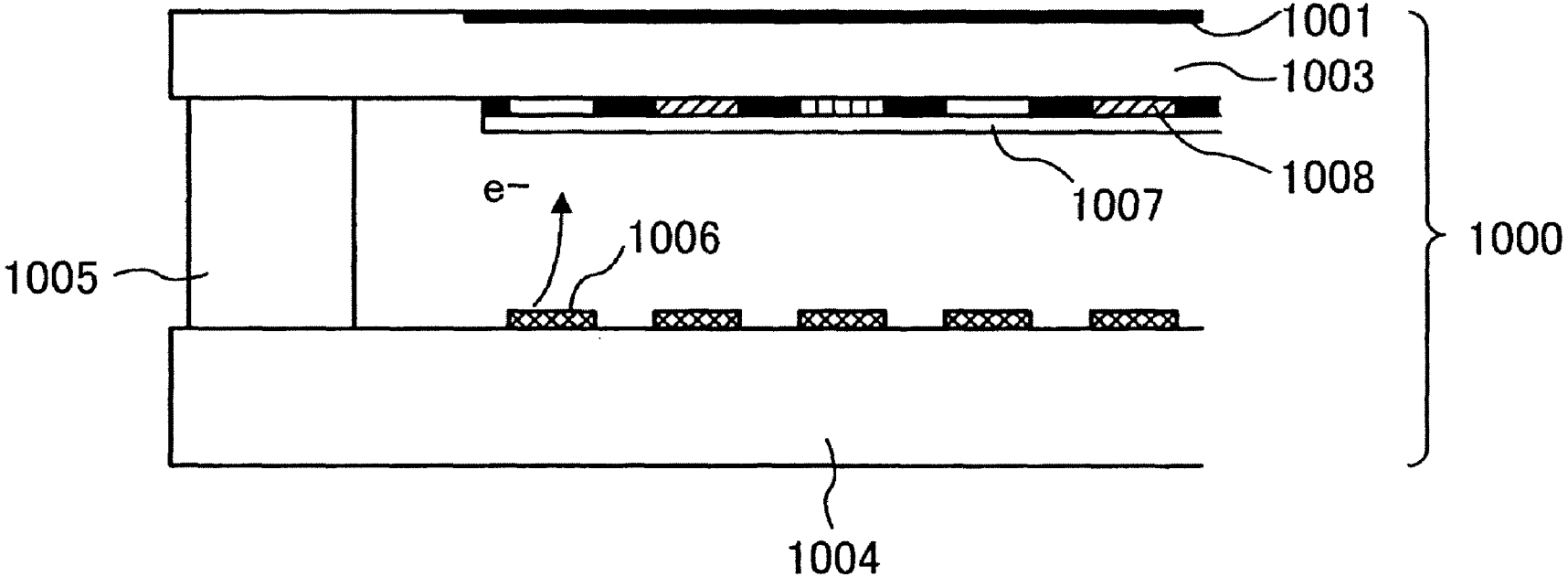
FIG. 2 is a typical view showing a cross section of the main body of the image display apparatus.

FIG. 2 shows a partial cross sectional typical view of the image display apparatus main body 1000. The image display apparatus main body 1000 is provided with a rear plate (a first substrate) 1004 having an electron-emitting device 1006 and a face plate (a second substrate) 1003 having a metal back (an anode electrode) 1007 and a light emitting film 1008. As shown in FIG. 2, the first substrate 1004 and the second substrate 1003 are arranged so as to be opposed with each other, and the anode electrode 1007 is opposed to the electron-emitting device 1006.

Then, a space between the second substrate 1003 and the first substrate 1004 is kept at a pressure that is lower than an atmosphere pressure (preferably, being kept vacuum). In order to maintain this space, a supporting frame member 1005 is provided between the first substrate 1004 and the second substrate 1003. Then, although it is not shown in FIG. 2, an atmosphere pressure supporting member (a spacer) that has been publicly known conventionally can be also provided.

The image display area 1001 is a partial area (an area where the light emission from the light emitting film 1008 can be checked visually) of the upper face (the face that is an opposite face to the first face located on the first substrate side; the second face) of the face plate (the second substrate) 1003.

Figure 9:
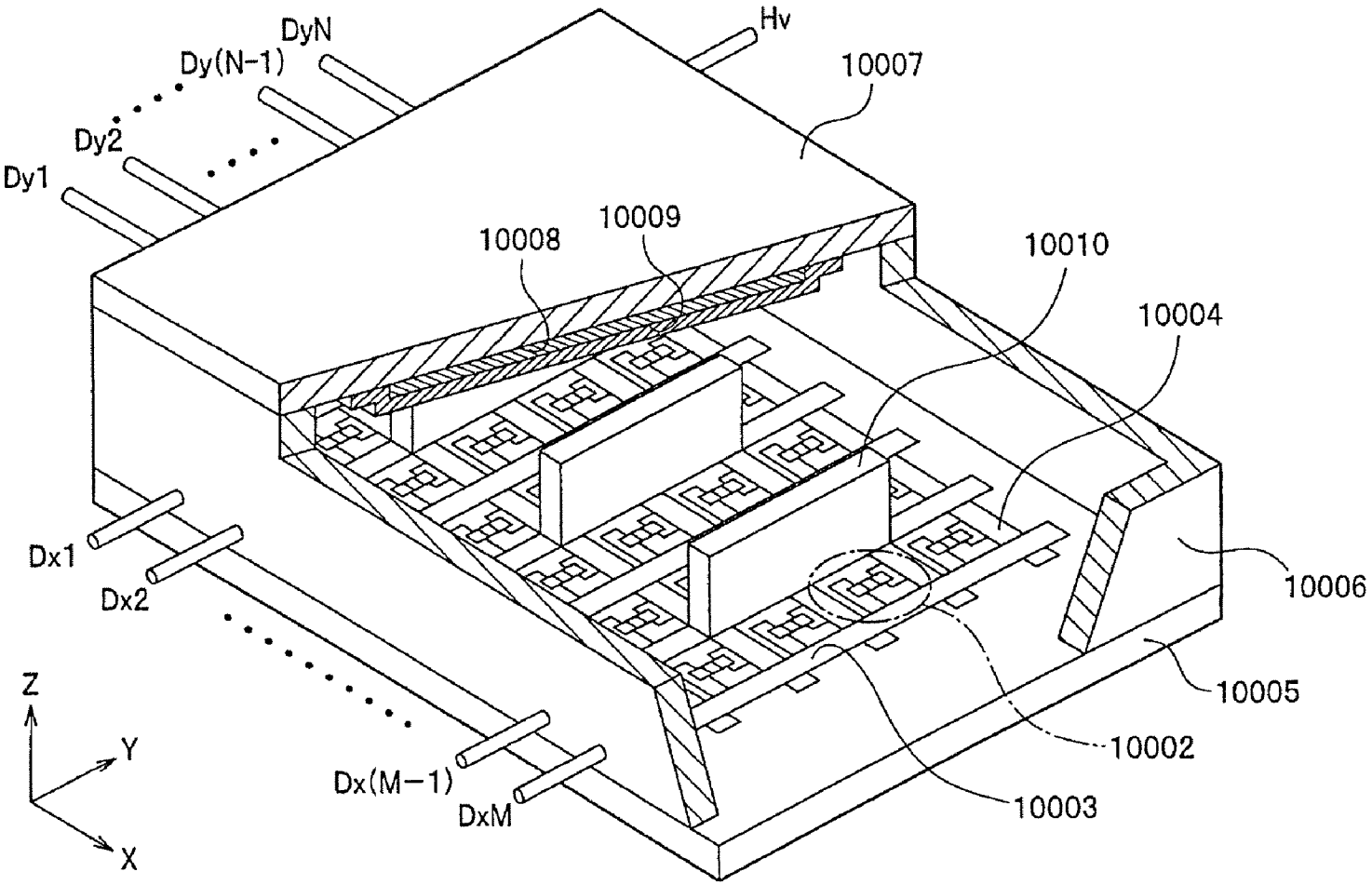
FIG. 9 is an oblique perspective figure showing an example of a display panel of a conventional image display apparatus.

Thus, the principal configuration of the image display apparatus main body is the same as the conventional image display apparatus such as an image display apparatus shown in FIG. 9.

As the rear plate (the first substrate) 1004 and the face plate (the second substrate) 1003, a glass substrate may be practically used. As the metal back (the anode electrode) 1007, a metal film may be used and practically, an aluminum film may be available.

Figure 3:
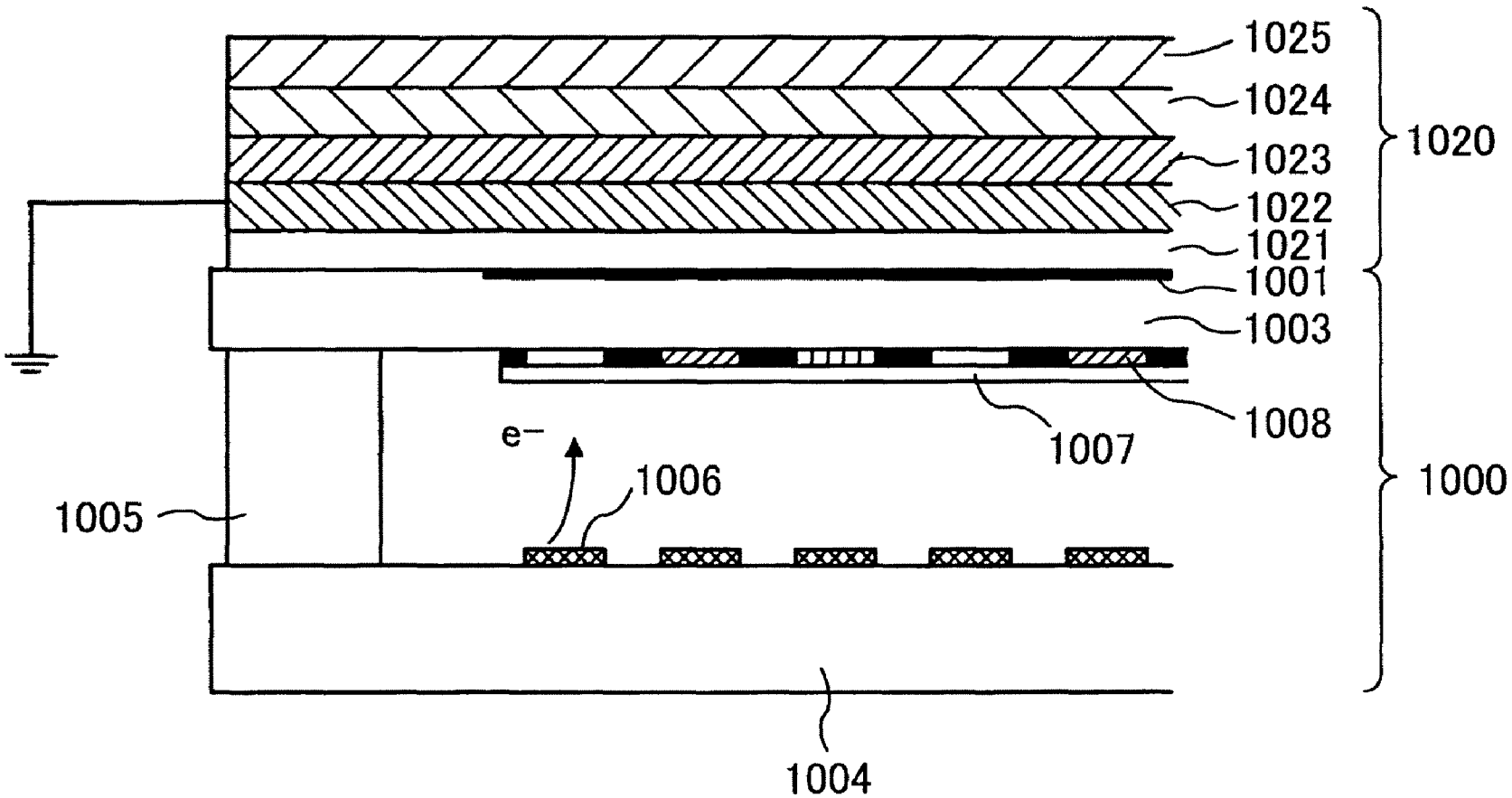
FIG. 3 is a cross sectional typical view of the image display apparatus according to the first embodiment of the present invention.

FIG. 3 is a partial cross sectional typical view showing the state that the functional film 1020 is provided on the upper face (the face that is an opposite face to the first face located on the first substrate side; the second face) of the second substrate 1003 shown in FIG. 2. In the functional film 1020 to be described here, as shown in FIG. 1 and FIG. 3, an adhesion layer 1021, a conductive layer 1022, an insulating base 1023, an antireflection layer 1024, and a protection layer 1025 are accumulated on the upper face (the second face) of the second substrate 1003 in this order toward the side of a viewer. In other words, the conductive layer 1022, the insulating base 1023, the antireflection layer 1024, and the protection layer 1025 are provided on the side of the second face of the second substrate 1003. In addition, the conductive antireflection layer is provided to be located on the opposite side of the conductive layer from the second substrate. The conductive layer is fixed on one face of the insulating base, and the antireflection layer is fixed on the other face of the insulating base.

According to the present embodiment, the functional film 1020 having a plurality of layers is exemplified; however, the functional film 1020 may include at least the conductive layer 1022. Basically, the layer other than the conductive layer 1022 can be added appropriately according to need.

In addition, the conductive layer 1022 can also have an antireflection function. If the conductive layer 1022 has the antireflection function, the antireflection layer 1024 can be omitted. In addition, it is preferable that the functional film is one that is pasted on the upper face (the second face) of the face plate 1003 of the prepared image display apparatus main body 1000. In other words, it is preferable that the functional film is configured by the conductive layer 1022 and the adhesive layer 1021, and then, the conductive layer 1022 is pasted on the upper face (the second face) of the second substrate including the image display area of the second substrate via the adhesive layer 1021.

However, the conductive layer 1022 is very thin, so that it is difficult to paste the conductive layer 1022 on the upper face (the second face) of the face plate 1003 after the image display apparatus main body 1000 is formed. Therefore, it is more preferable that the functional film is configured by depositing the conductive layer 1022 and the adhesive layer 1021 on the insulating base in advance.

As the insulating base, one having a certain level of rigidity, an insulation property, and optical transparency is preferable. In the case that the functional film is configured in this way, even if layers having many other functions shown in FIG. 1 and FIG. 3 are further accumulated, the functional film can be easily pasted on the upper face (the second face) of the face plate 1003.

In addition, it is preferable that the potential of the conductive layer 1022 is set to be lower than that of the anode electrode when displaying the image. According to the present embodiment, as shown in FIG. 3, by grounding the conductive layer 1022 of the functional film 1020 on the electrode (not illustrated) connected to a ground, the surface potential of the functional film 1020 is set to be a ground potential (0[V]).

In addition, the height of the supporting frame member 1005 is selected in the range of not less than 500 μm and not more than 10 mm for practical purposes; and, according to the present embodiment, the height of the supporting frame member 1005 is determined to 1 mm.

Here, the anode voltage to be applied to the metal back 1007 is determined to be about 12 kV, so that an electric field between the face plate 1003 and the rear plate 1004 is made into a high electric field not less than $10^6$ (V/m). Accordingly, if there is an electric field concentrated point inside the image display apparatus, an unexpected electric discharge may be generated. As a result, an electric charge of the metal back 1007 on the face plate 1003 may flow into the electron-emitting device 1006 on the rear plate 1004 and the wiring (not illustrated) or the like due to electric discharge. Thus, this leads to destruction of electron-emitting device 1006 and destruction of the drive circuit and it has possibilities that a serious defect of the image quality may be caused.

Therefore, according to the present embodiment, the surface resistance of the metal back 1007 is set to be not less than $10^5$ (Ω/□). Thereby, the current limiting function is given to the image display apparatus so that large amounts of electric charge do not flow into the electron-emitting device 1006 on the rear plate 1004, a wiring (not illustrated), and the drive circuit in case that the electric discharge is generated inside the image display apparatus. As one of principal differences between the image display apparatus main body (the display panel) according to the present embodiment and the conventional image display apparatus main body (the display panel), such a point that a surface resistance is given to the metal back (the anode electrode) 1007 may be considered.

Further, the surface resistance of the above-described anode electrode 1007 can be defined by measuring the sheet resistance on an area of 200 mm×200 mm on the anode electrode 1007, to which the resistance of other layer is combined. Specifically, by bringing two electrodes having a length of 200 mm into contact with the anode electrode 1007 apart from each other 200 mm and obtaining the resistance value between the electrodes, the surface resistance of the anode electrode 1007 can be calculated.

As a method to increase the above-described sheet resistance (the surface resistance), a conventionally publicly-known method, for example, a method for dividing the metal back into plural areas and connecting respective areas by a resistive member can be accordingly adopted.

An example such a method is disclosed in JP-A No. 2005-235470 (U.S. Patent Publication No. 2005/0179398), for example.

Figure 10:
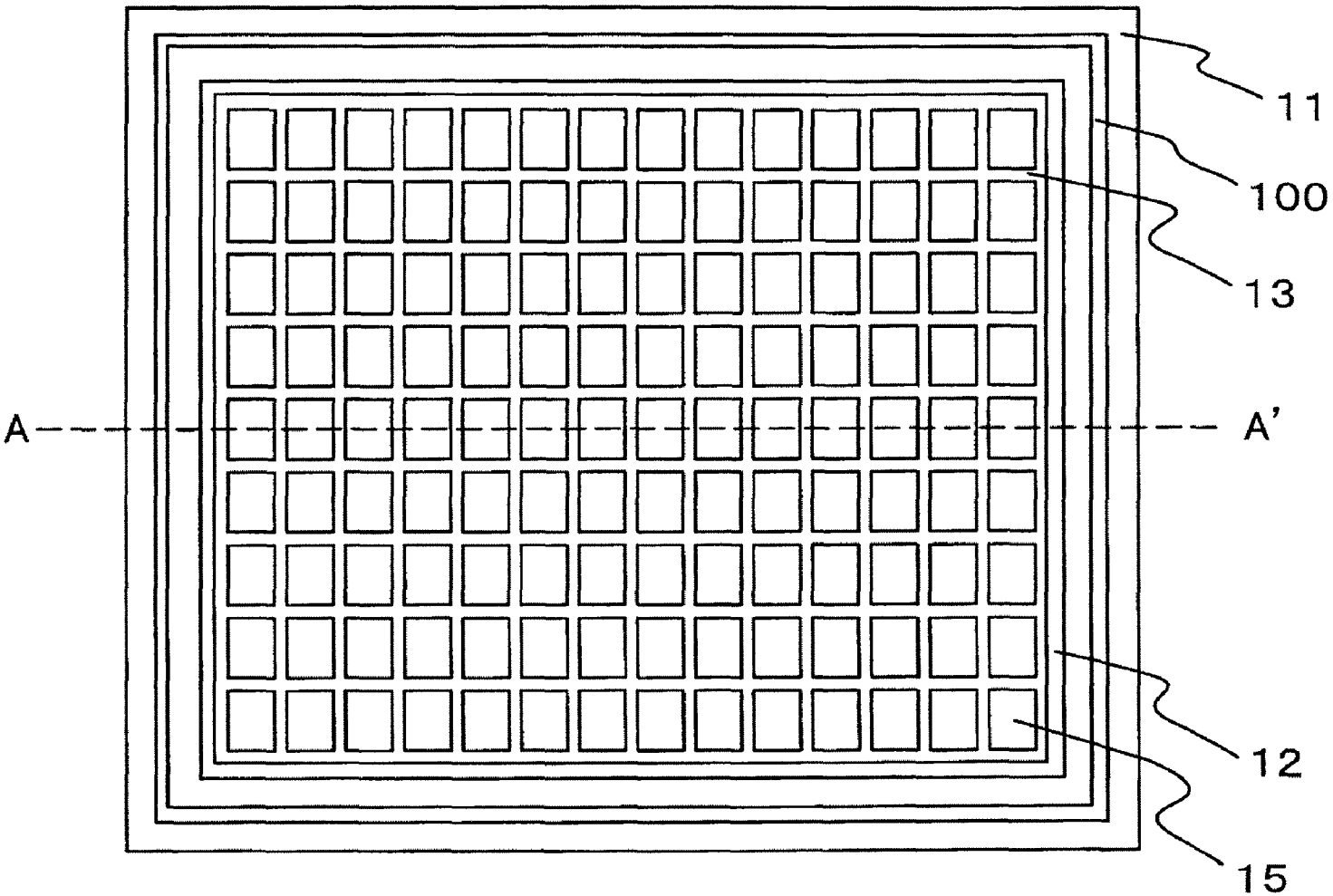
FIG. 10 is a plan view of the face plate as seen from the side of a rear plate.
Figure 11:
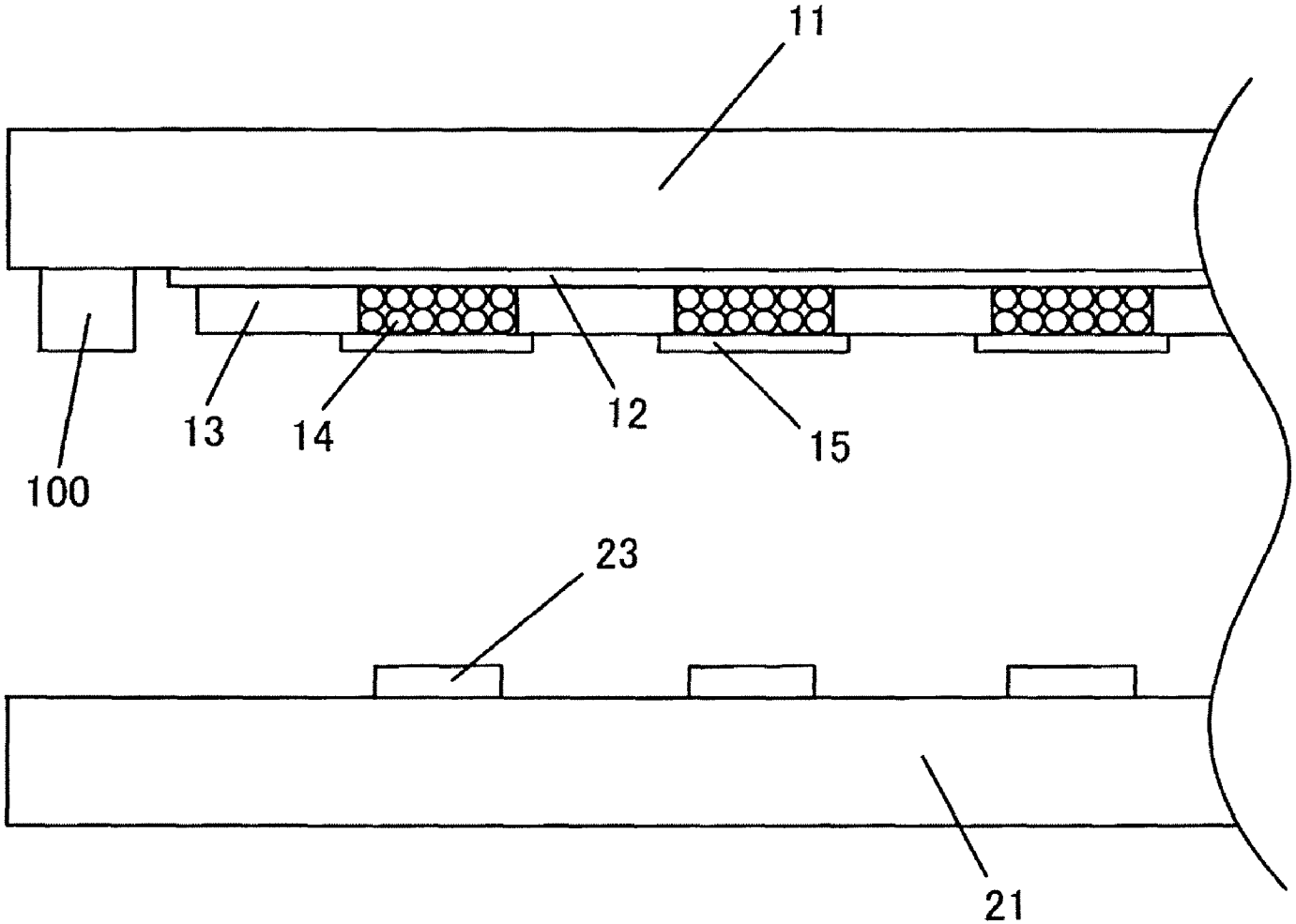
FIG. 11 is a view showing a cross section taken on a line A-A' of FIG. 10.

FIG. 10 and FIG. 11 show the constitution of the face plate that can preferably adopt the present invention. FIG. 10 is a plan view of the face plate seen from the side of the rear plate. FIG. 11 is an enlarged view of a part of the cross section taken on a line A-A' of FIG. 10. Further, FIG. 11 also illustrates a rear plate 21 and an electron-emitting device 23.

The face plate shown in FIG. 10 and FIG. 11 can be manufactured by the following steps, for example.

At first, as a conductive area on the cleaned glass substrate 11, an ITO film 12 is developed on the entire face of the image display area according to a spattering method. A sheet resistance value of the ITO film 12 is defined to be 100Ω/□, for example. A part of the ITO film 12 is connected to a high voltage electric source, and a high voltage potential (an anode potential) is supplied thereto.

Next, printing a paste containing silver particles and glass frits so as to encircle the ITO film 12 as shown in FIG. 10 according to a screen printing method and burning it at 400° C., a potential defining electrode 100 is formed. The width of the potential defining electrode 100 is defined to be 2 mm and the potential defining electrode 100 is formed so as to be separated from the outer circumference of the conductive area 4 mm. The resistance value of the potential defining electrode 100 is defined to be not more than 1Ω. Further, a reason for providing the potential defining electrode 100 will be described later.

Next, as an interval defining member, a black matrix 13 of a high resistance, which has a lattice-shape a thickness 10 μm, a width 250 μm, and an opening of 200 μm×200 μm, is formed by a screen printing method using an oxidized ruthenium paste.

Next, according to the screen printing method, respective phosphors 14 of R, G, and B are filled in respective openings of the black matrix 13 in three times for each color so as to have the thickness 10 μm. Although the phosphor can be filled therein by using the screen printing method, it is obvious that the present embodiment is not limited to this and for example, a photolithography method or the like may be available. In addition, as a phosphor 14, a phosphor of P22 that has been used in a field of CRT is used. As a phosphor, red (P22-RE3; $Y_2O_2S$: $Eu^{3+}$), blue (P22-B2; ZnS: Ag, Al), and green (P22-GN4; ZnS:Cu, Al) ones are used.

Next, according to a filming step (smoothing processing by a lacquer or the like) that has been publicly known as a manufacturing art of a Braun tube (cathode-ray tube), a resin film is developed on the black matrix 13 and the phosphor 14. After that, Al films are accumulated on the resin film by an evaporation method. Then, by thermally decomposing and removing the resin film, the conductive film of the thickness 100 nm (the Al film) is arranged on the black matrix 13 and the phosphor 14.

After that, by a YAG laser processing machine, the conductive film (the Al film) is cut to be divided into the conductive film 15 for each pixel.

Thus, the face plate shown in FIGS. 10 and 11 can be formed. The resistance value of the anode electrode can be defined to be a predetermined value by appropriately selecting the size and the material of each member.

Figure 8:
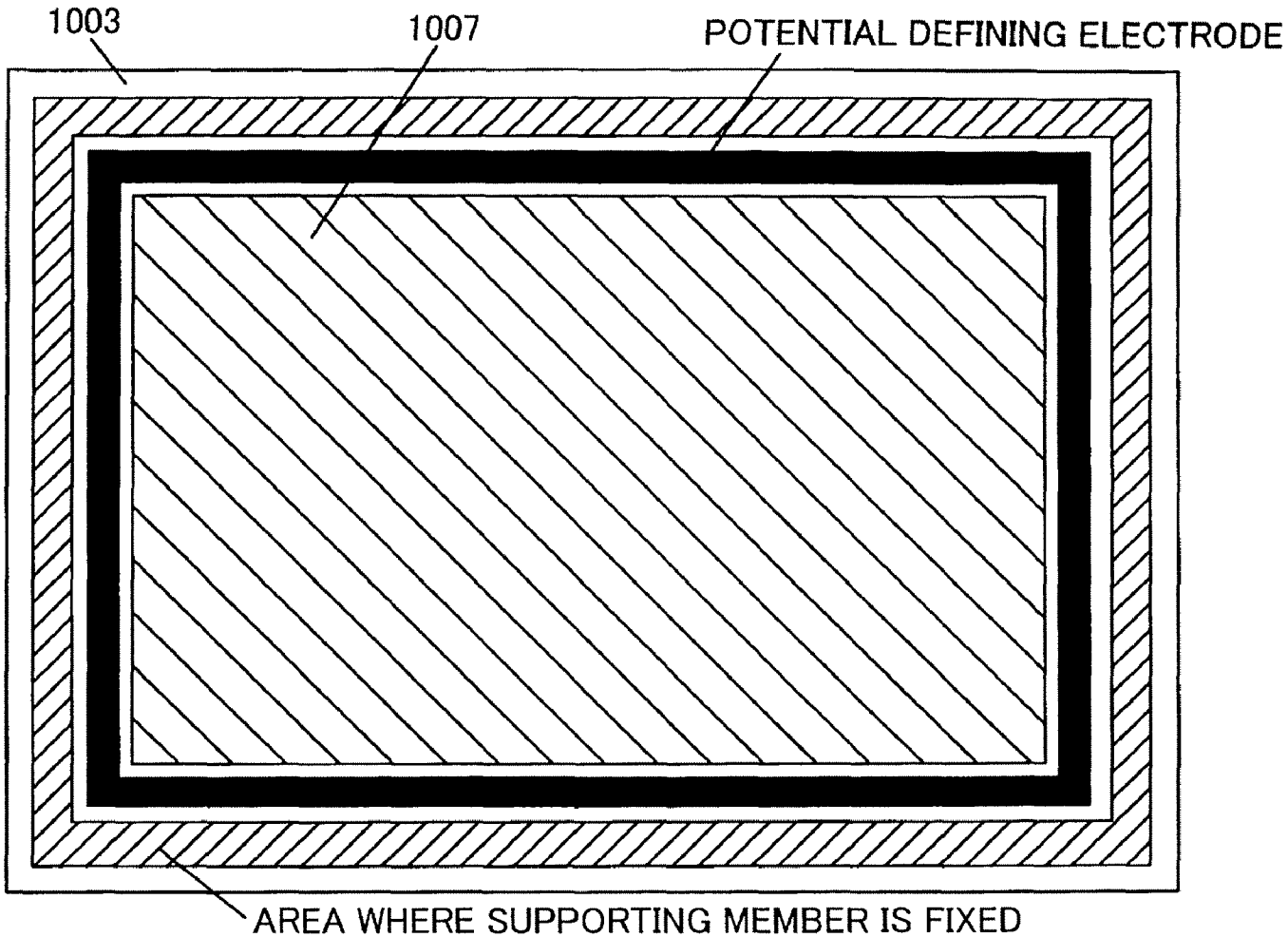
FIG. 8 is a plan typical view of the face plate.

FIG. 8 is a plan typical view of the second substrate (the face plate) 1003 of the image display apparatus according to the present embodiment seen from the side of the electron-emitting device 1006. Also for the image display apparatus according to the present embodiment, as shown in FIG. 8, it is preferable that the potential defining electrode is provided apart from the anode electrode 1007 at a predetermined distance on the first face of the face plate 1003. The potential defining electrode is arranged around the anode electrode 1007. In other words, it is preferable that the potential defining electrode is provided between the outer circumference of the anode electrode 1007 and the outer circumference of the face plate 1003 apart from the anode electrode 1007 at a predetermined distance.

Then, in the case of providing the potential defining electrode, it is more preferable that the potential defining electrode is arranged so as to encircle the outer circumference of the anode electrode 1007 as shown in FIG. 8.

The potential defining electrode is practically provided inside the area where the supporting frame member 1005 on the face plate is fixed. Further, also in FIG. 8, the potential defining electrode is provided apart from the area where the supporting frame member 1005 is fixed at a predetermined distance, however, a part of the potential defining electrode may be elongated up to a part of the area where the supporting frame member 1005 is fixed. In addition, a part of the potential defining electrode may be elongated on the entire area of the area where the supporting frame member 1005 is fixed.

By providing such a potential defining electrode, the electric field generated between the anode electrode 1007 and the supporting frame member or the like can be controlled. As a result, a distance between the supporting frame member 1005 and the anode electrode 1007 can be reduced.

On the other hand, such a potential defining electrode is maintained at a potential sufficiently lower than the potential of the anode electrode when driving the image display apparatus (when displaying the image). Typically, the potential of the potential defining electrode is maintained at a ground potential. Therefore, the end on the side of the anode electrode of the potential defining electrode is exposed to the high electric field and the electric discharge may be generated between the potential defining electrode and the anode electrode.

Therefore, in order to reduce the electric field intensity at the end on the side of the anode electrode of the potential defining electrode, according to the present embodiment, it is preferable that a conductive film to form the functional film 1020 covers the entire or almost entire upper face (the second face) of the second substrate 1003. In other words, it is preferable that the conductive film to configure the functional film 1020 covers not only the image display area of the second substrate 1003 but also the upper face (the second face) of the second substrate 1003 that is located just above the end of the side of the anode electrode of the potential defining electrode. Thus, the intensity of the electric field generated on the end on the side of the anode electrode of the potential defining electrode can be reduced. As a conductive film to configure the functional film 1020, for example, the conductive layer 1022 and the conductive antireflection layer 1024 or the like are cited.

In addition, according to the constitution shown in FIG. 8, since the potential defining electrode is provided apart from the anode electrode 1007 at a predetermined distance, the surface of the second substrate 1003 is exposed between the anode electrode 1007 and the potential defining electrode. As the second substrate, normally, the glass substrate is used. Therefore, the insulating surface is exposed between the anode electrode 1007 and the potential defining electrode. The insulating surface is easily charged, so that it is difficult to control the potential.

Therefore, it is preferable that a resistive film covers the surface (the first face) of the second substrate 1003, which is exposed between the anode electrode 1007 and the potential defining electrode. In other words, it is preferable that the anode electrode 1007 and the potential defining electrode are connected to each other via the resistive film. A sheet resistance of the resistive film is practically determined to be in the range of not less than $1\times10^7$ and not more than $1\times10^{15}$.

Accordingly, as shown in FIG. 8, in the case of arranging the potential defining electrode so as to encircle the outer circumference of the anode electrode 1007, the resistive film encircles the outer circumference of the anode electrode 1007.

According to the present embodiment, in order to maintain the current limiting function of the anode electrode, the surface resistance of the conductive layer 1022 of the functional film 1020 is set at a predetermined relation. In other words, the surface resistance of the conductive layer 1022 is set to be the surface resistance that is higher than the surface resistance of the anode electrode.

Further, it is preferable that the surface resistance value of the conductive layer 1022 is set to be at least one order higher than the surface resistance value of the anode electrode, and to be not more than $1\times10^8$ (Ω/□). The surface resistance value of the conductive layer 1022 of the functional film 1020 is not necessarily limited to a value to be described later. The surface resistance value of the conductive layer 1022 can be appropriately determined by the surface resistance of the metal back 1007, the maximum permissive attained potential of the surface of the image display apparatus, the relaxation time until the potential of the surface of the image display apparatus are stabilized, or the like.

Specifically, the practical value of the surface resistance of the conductive layer 1022 is preferably set to be in the range of not less than $1\times10^6$ (Ω/□) and not more than $1\times10^8$ (Ω/□) in the case that the surface resistance of the anode electrode is about $10^4$ to $10^6$ (Ω/□).

In addition, as shown in FIG. 3, in the case that the functional film 1020 is provided with the conductive antireflection layer 1024 in addition to the conductive layer 1022, the surface resistance of the antireflection layer is also set to be higher than the surface resistance of the anode electrode.

Specifically, in the case that the surface resistance of the anode electrode is about $10^4$ to $10^6$ (Ω/□), it is preferable that the surface resistance of the conductive antireflection layer is in the range of not less than $1\times10^9$ (Ω/□) and not more than $1\times10^{14}$ (Ω/□).

The measuring method of the surface resistance of the conductive layer and the conductive antireflection layer is same as the measuring method of the surface resistance of the anode electrode. By separating two electrodes having the length of 200 mm at a distance of 200 mm and bringing these two electrodes into contact with the conductive layer or the antireflection layer and obtaining the resistance value between the electrodes, the surface resistance of the conductive layer or the conductive antireflection layer can be calculated.

In the case that the functional film 1020 is provided with the conductive layer 1022 or the conductive antireflection layer 1024, if the surface resistance of the functional film 1020 is lower than the surface resistance of the metal back 1007, the apparent electric charge amount of the metal back is largely increased. As a result, in case that the electric discharge is generated inside the image display apparatus, the current limiting effect due to the metal back 1007 is decreased. Therefore, it is desirable that the surface resistance of the functional film 1020 is sufficiently higher than the surface resistance of the metal back 1007.

Normally, the functional film 1020 is provided with at least the conductive layer 1022. Then, the functional film 1020 may be provided with single or plural conductive films such as a conductive antireflection layer 1024. Accordingly, it is preferable that all of the surface resistances of the conductive films such as the conductive layer 1022 and the conductive antireflection layer 1024 of the functional film 1020 are set to be at least one order higher than the surface resistance of the metal back 1007 as described above.

According to the present embodiment, since the conductive layer 1022 is grounded to a ground to define the potential of the surface of the image display apparatus, the surface resistance of the conductive layer 1022 is set to be lower than the surface resistance of the antireflection layer 1024.

Figure 4:
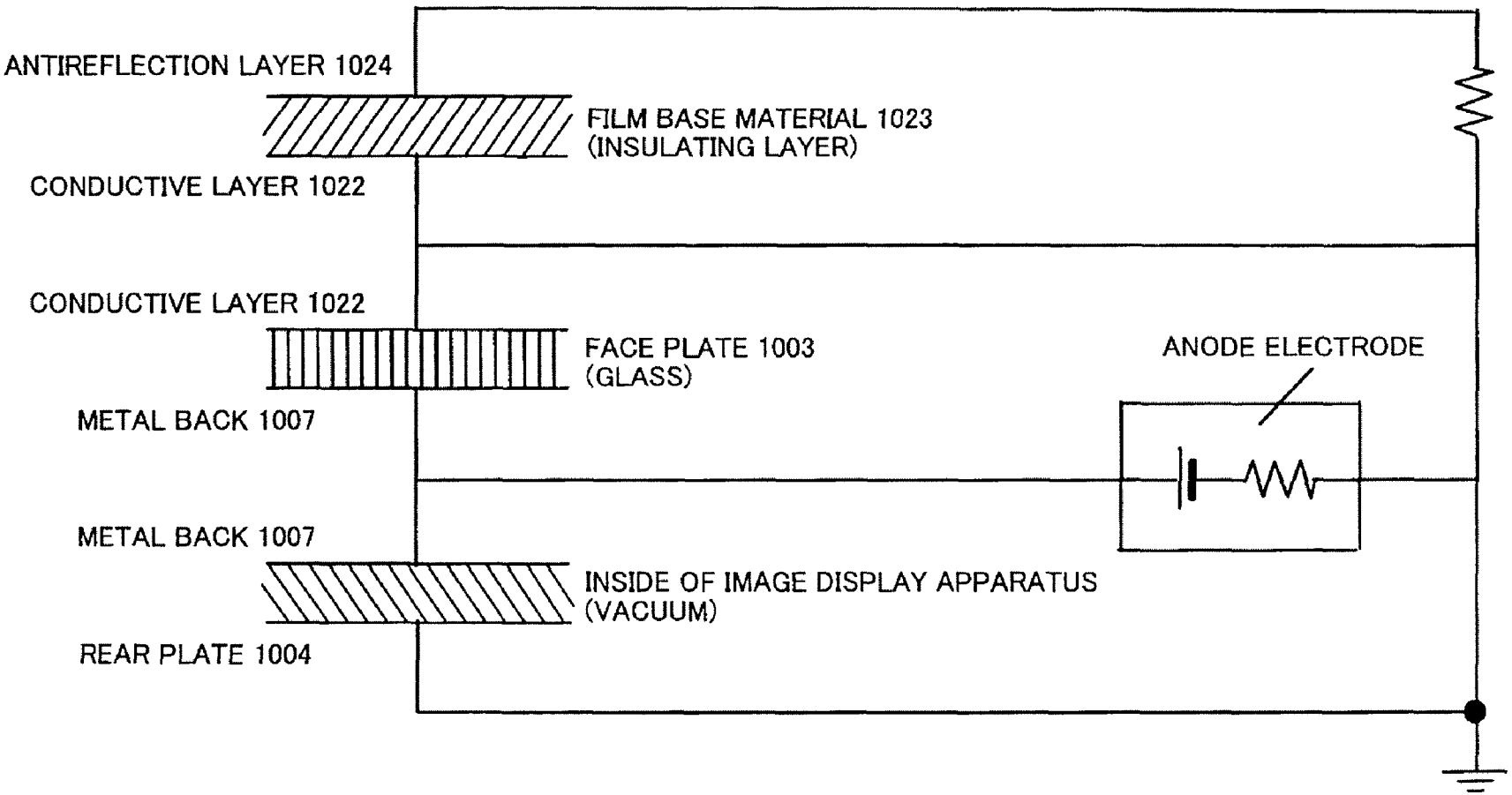
FIG. 4 is a view showing an equivalent circuit of a functional film and a face plate.

FIG. 4 shows an equivalent circuit of the functional film 1020 and the face plate 1003 in the case that the functional film 1020 is provided with the conductive layer 1022 and the conductive antireflection layer 1024.

By setting the conductive layer 1022 and the conductive antireflection layer 1024 in the above-described range of the surface resistance, the potential of the surface can be defined without losing the current limiting effect due to the metal back 1007 when the electric discharge is generated.

Figure 5:
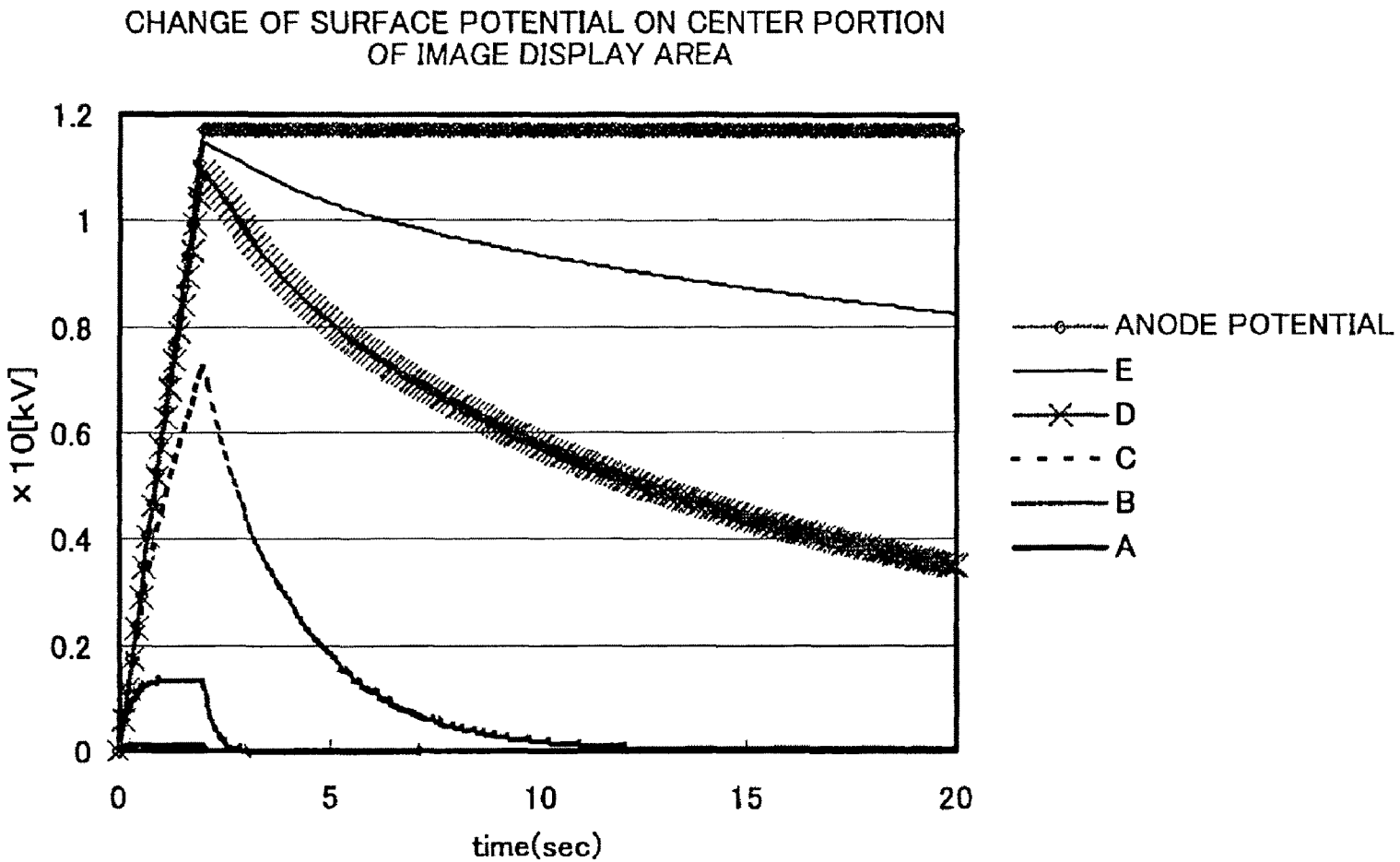
FIG. 5 is a view showing a correlation between a potential of a surface of an image display apparatus and a resistance of a conductive layer.
Figure 6:
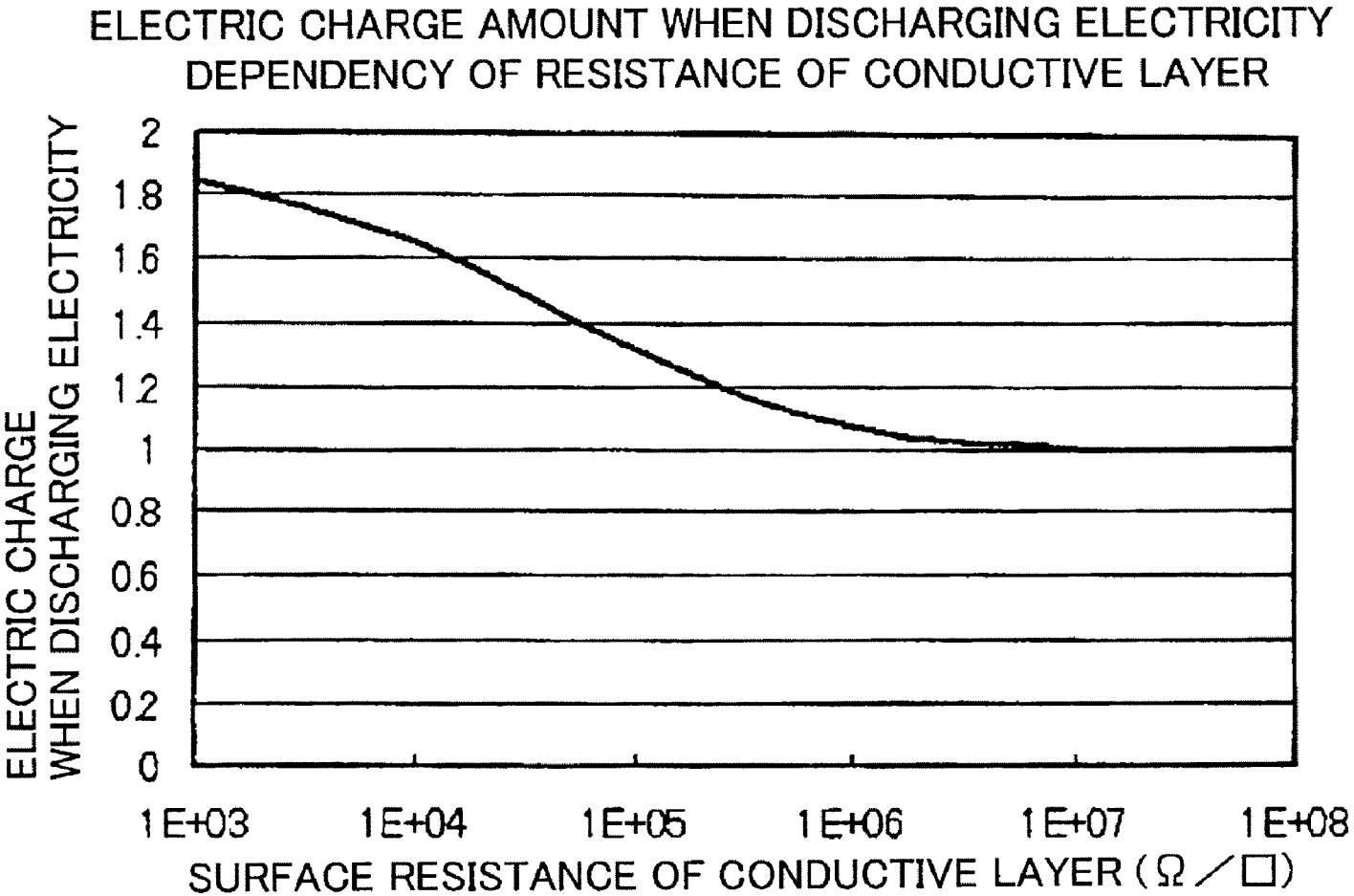
FIG. 6 is a view showing a correlation between an electric charge amount flowing into a rear plate due to an electric discharge and a resistance of a conductive layer.

FIG. 5 shows a correlation between the potential of the surface of the image display apparatus and the resistance of the conductive layer 1022. In addition, FIG. 6 shows a correlation between an electric charge amount flowing into a rear plate due to an electric discharge and the resistance of the conductive layer 1022. Further, when the size of the image display area (an opposing corner) is 55 inch, the surface resistance of the anode electrode is calculated as about $10^5$ (Ω/□) with reference to FIG. 5 and FIG. 6.

In FIG. 5, A shows the case that the surface resistance of the conductive layer 1022 is $1\times10^6$Ω/□, B shows the case that the surface resistance of the conductive layer 1022 is $1\times10^7$Ω/□ and C shows the case that the surface resistance of the conductive layer 1022 is $1\times10^8$Ω/□. In addition, D shows the case that the surface resistance of the conductive layer 1022 is $1\times10^9$Ω/□ and E shows the case that the surface resistance of the conductive layer 1022 is $1\times10^{10}$Ω/□.

From FIG. 5, it is known that the sheet resistance is desirably not more than $1\times10^8$Ω/□ in order to sufficiently lower the surface potential on the center portion of the image display apparatus for several seconds just after the drive electric source (the anode electrode) of the image display apparatus is turned on.

On the other hand, from FIG. 6, it is known that the electric charge to be moved to the side of the rear plate is sufficiently reduced upon discharge of electricity if the sheet resistance is at least about $1\times10^6$ (Ω/□) and this electric charge is hardly decreased even if the surface resistance is increased more than $1\times10^6$ (Ω/□).

Accordingly, when the surface resistance of the anode electrode is about $1\times10^5$ (Ω/□), the surface resistance of the conductive layer 1022 is preferably set to be in the range of not less than $1\times10^6$ (Ω/□) and not more than $1\times10^8$ (Ω/□). In addition, in the case that the functional film is provided with other conductive film in addition to the conductive layer 1022, the surface resistance value of each conductive film to configure the functional film is set in the range of not less than $1\times10^6$ (Ω/□) and not more than $1\times10^8$ (Ω/□). Thus, damage upon discharging electricity is decreased, so that the surface potential of the display area can be sufficiently lowered just after the electric source is turned on.

According to the image display apparatus of the present embodiment, the stable display image can be maintained for a long period of time.

Second Embodiment

Next, an image display apparatus according to the second embodiment of the present invention will be described below.

Figure 7:
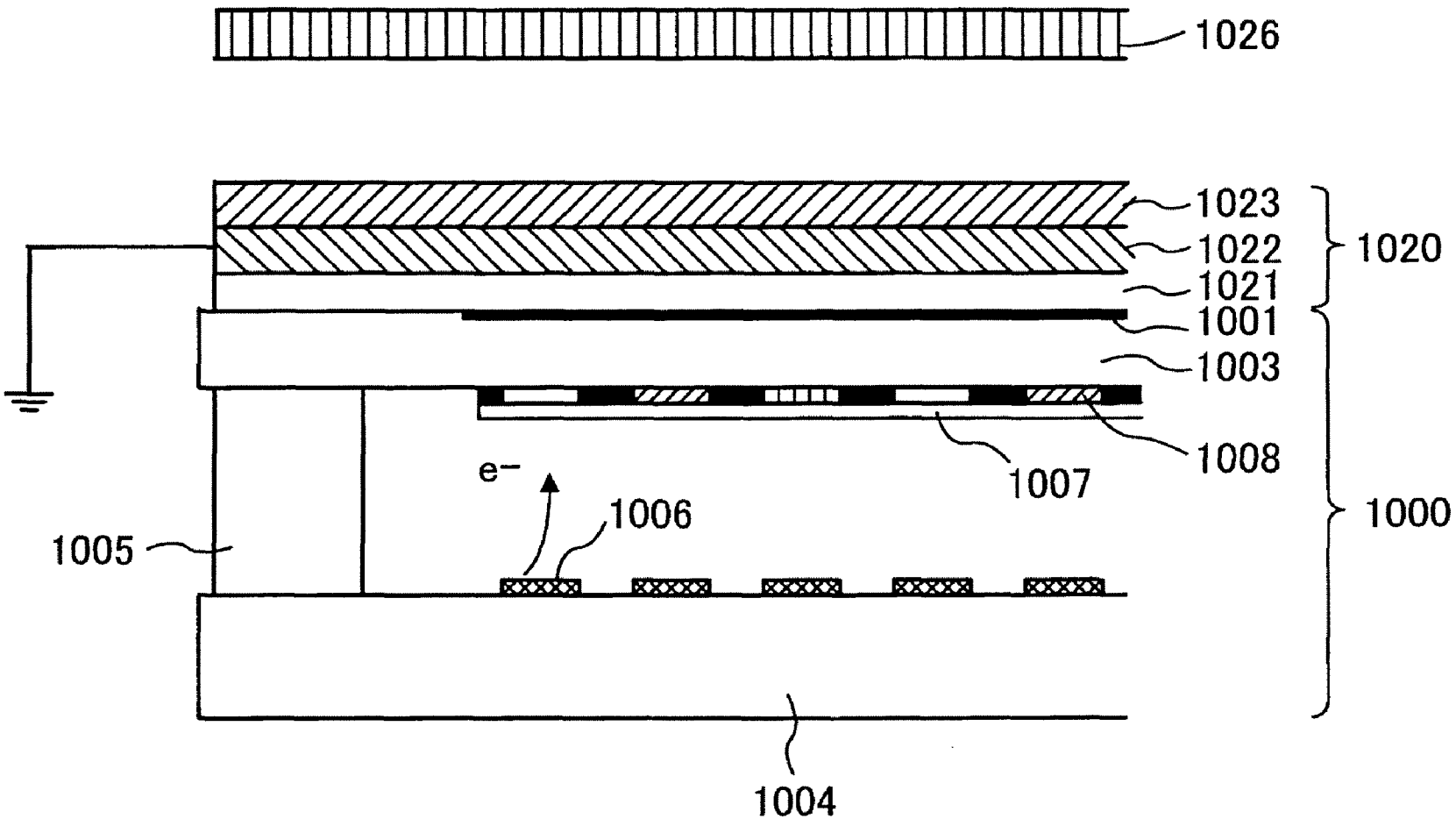
FIG. 7 is a typical view showing a cross section of an image display apparatus according to a second embodiment of the present invention.

FIG. 7 shows a partial cross sectional typical view of an image display apparatus according to the second embodiment of the present invention. The basic function of the present embodiment is the same as the constitution shown in the first embodiment, however, a front plate (a third substrate) 1026 is provided with the antireflection function and the functional film to be directly mounted on the face plate does not include the antireflection function. In other words, the front plate (the third substrate) 1026 having the antireflection property is provided on the side of the second face of the second substrate (the face plate) 1003.

The front plate 1026 is a substrate that is optically transparent and is located on the side of the second face of the second substrate (the face plate) spatially apart from the conductive layer. In other words, the front plate 1026 is provided spatially apart from the functional film. As the front plate 1026, for example, a polycarbonate can be used.

Accordingly, a limitation of a surface resistance of each layer is the same as the range of the first embodiment, and it is necessary for the resistance of the conductive layer 1022 to be larger than the resistance of the metal back 1007.

According to the present embodiment, it is defined that the surface resistance of the metal back 1007 is $1\times10^5$ (Ω/□) and the surface resistance of the conductive layer 1022 of the functional film 1020 is in the range of not less than $1\times10^6$ (Ω/□) and not more than $1\times10^8$ (Ω/□).

It is obvious that the surface resistance value of the conductive layer 1022 of the functional film 1020 is not limited to the value determined in the present embodiment. The surface resistance value of the conductive layer 1022 of the functional film 1020 may be appropriately determined by the surface resistance of the metal back 1007, the maximum permissive attained potential of the surface of the image display apparatus, the relaxation time until the potential of the surface of the image display apparatus are stabilized, or the like. In other words, if a relation of the surface resistance value satisfies a relation of "the surface resistance value of the metal back 1007<the surface resistance value of the conductive layer 1022", the current limiting function upon discharge of an electricity to be generated inside the image display apparatus is effective and the surface potential of the image display apparatus can be defined.

According to the image display apparatus of the present embodiment, it is possible to maintain a stable display image for a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-352369, filed on Dec. 27, 2006, which is hereby incorporated by reference herein in its entirety.

This application claims the benefit of Japanese Patent Application No. 2007-264751, filed on Oct. 10, 2007, which is hereby incorporated by reference herein in its entirety.

What is claimed is:

1. An image display apparatus comprising:

a first substrate having an electron-emitting device;

a second substrate having an anode electrode that is opposed to the electron-emitting device; and a conductive layer that is provided on the side of a second face of the second substrate, the second face being an opposite face to a first face of the second substrate, the first face being located on the first substrate side, wherein a potential of the conductive layer is set to be lower than a potential of the anode electrode when displaying an image; and a surface resistance of the conductive layer is at least one order higher than a surface resistance of the anode electrode and not more than $1\times10^8$ Ω/square.

2. An image display apparatus according to claim 1, wherein a potential defining electrode is provided on the first face of the second substrate apart from the anode electrode;

the conductive layer is provided so as to cover an image display area of the second face and an area of the second face corresponding to an end on the side of the anode electrode of the potential defining electrode; and a potential of the potential defining electrode is set to be lower than the potential of the anode electrode when displaying an image.

3. An image display apparatus according to claim 2, wherein the potential defining electrode is provided so as to encircle the anode electrode on the second substrate.

4. An image display apparatus according to claim 2, wherein the potential of the potential defining electrode is a ground potential.

5. An image display apparatus according to claim 2, wherein the potential defining electrode and the anode electrode are connected to each other via a resistive film.

6. An image display apparatus according to claim 1, wherein the potential of the conductive layer is a ground potential.

7. An image display apparatus according to claim 1, further comprising:

a third substrate that is provided on the side of the second face of the second substrate;

wherein the third substrate is provided on the side of the second face spatially apart from the conductive layer and has an antireflection property.

8. An image display apparatus according to claim 1, further comprising:

a conductive antireflection layer that is provided to be located on the opposite side of the conductive layer from the second substrate and is set to be lower than the potential of the anode electrode when displaying an image;

wherein a surface resistance of the antireflection layer is higher than the surface resistance of the anode electrode.

9. An image display apparatus according to claim 8, wherein the surface resistance of the antireflection layer is higher than the surface resistance of the conductive layer.

10. An image display apparatus according to claim 1, wherein the conductive layer is fixed on an insulating base; and the conductive layer is attached on the second face of the second substrate via an adhesive layer, the adhesive layer being provided between the conductive layer and the second face.

11. An image display apparatus according to claim 8, wherein the conductive layer is fixed on one face of an insulating base and the antireflection layer is fixed on the other face of the insulating base; and the conductive layer is attached on the second face of the second substrate via an adhesive layer, the adhesive layer being provided between the conductive layer and the second face.

12. A functional film mounted on an image display apparatus including a first substrate having an electron-emitting device and a second substrate having an anode electrode that is opposed to the electron-emitting device, the functional film comprising a conductive layer that is provided on the side of a second face of the second substrate, the second face being an opposite face to a first face of the second substrate, the first face being located on the first substrate side, wherein a potential of the conductive layer is set to be lower than a potential of the anode electrode when displaying an image; and a surface resistance of the conductive layer is at least one order higher than a surface resistance of the anode electrode and not more than $1\times10^8$ Ω/square.

13. A manufacturing method of an image display apparatus comprising the steps of:

preparing a display panel including a first substrate having an electron-emitting device and a second substrate having an anode electrode that is opposed to the electron-emitting device; and providing a conductive layer on the side of a second face of the second substrate, the second face being an opposite face to a first face of the second substrate, the first face being located on the first substrate side, wherein a potential of the conductive layer is set to be lower than a potential of the anode electrode when displaying an image; and a surface resistance of the conductive layer is at least one order higher than a surface resistance of the anode electrode and not more than $1\times10^8$ Ω/square.

14. An image display apparatus according to claim 1, wherein the conductive layer is provided on an image display area of the second face.

15. An image display apparatus according to claim 1, wherein the anode electrode consists of a plurality of conductive film and resistant which connects the plurality of conductive film.

16. An image display apparatus according to claim 1, wherein the surface resistance of the anode electrode is not less than $1\times10^4$ Ω/square and not more than $1\times10^6$ Ω/square.

* * * * *